United States Patent [19]

Gupta et al.

[11] Patent Number: 4,651,728

[45] Date of Patent: Mar. 24, 1987

[54] BREATHING SYSTEM FOR HIGH ALTITUDE AIRCRAFT

[75] Inventors: Alankar Gupta, Seattle; Michael B. McGrady, Federal Way, both of Wash.; John B. Tedor, San Antonio, Tex.

[73] Assignee: The Boeing Company, Seattle, Wash.

[21] Appl. No.: 655,921

[22] Filed: Sep. 28, 1984

[51] Int. Cl.[4] ..... A62B 18/10

[52] U.S. Cl. ..... 128/201.28; 128/204.29; 128/205.25

[58] Field of Search ..... 128/202.11, 202.27, 128/204.18, 204.21, 204.22, 204.29, 201.28, 201.23, 205.25, 205.26; 98/1.5; 244/59, 118.5

[56] References Cited

U.S. PATENT DOCUMENTS

| | | | |
|---|---|---|---|
| 2,582,848 | 1/1952 | Price | 244/59 |
| 2,824,557 | 2/1958 | Mejean et al. | 128/202.11 |
| 2,877,966 | 3/1959 | Summers, Jr. | 244/59 |
| 3,215,057 | 11/1965 | Turek | 98/1.5 |
| 3,410,191 | 11/1968 | Jackson | 98/1.5 |
| 3,425,333 | 2/1969 | Wachter | 98/1.5 |
| 3,500,827 | 3/1970 | Paine | 128/142.5 |
| 3,593,735 | 7/1971 | Reiher | 137/88 |
| 3,720,501 | 3/1973 | Cramer et al. | 23/281 |
| 4,057,205 | 11/1977 | Vensel | 244/118 |
| 4,419,926 | 12/1983 | Cronin et al. | 98/1.5 |
| 4,499,914 | 2/1985 | Schebler | 128/204.21 |

*Primary Examiner*—Kyle L. Howell
*Assistant Examiner*—Daniel Haneiwich
*Attorney, Agent, or Firm*—Bruce A. Kaser

[57] ABSTRACT

A breathing system (10) is provided for supplying physiologically acceptable breathing gas (oxygen partial pressure greater than that required to prevent hypoxia) to a pilot of an aircraft. The system (10) includes a breathing mask (12) connected to a pressure regulator (14). The pressure regulator (14) is connected to a selector valve (32). Connected to the selector valve (32) is an onboard oxygen generating system (22) and a standby oxygen supply (24). The selector valve (32) selects breathing gas from one of these two sources. Also included in the system is an emergency oxygen bottle (26) connected to the regulator (14). Ambient air is supplied to the mask (12) by an ambient airflow duct (20) if for some reason none of the breathing gas sources (22, 24, 26) provide breathing gas to the regulator (14).

25 Claims, 5 Drawing Figures

BREATHING SYSTEM FOR HIGH ALTITUDE AIRCRAFT

GOVERNMENT INTEREST

The government has rights to this invention pursuant to Contract No. F33615-83-C-065 awarded by the U.S. Airforce.

DESCRIPTION

TECHNICAL FIELD

This invention relates to breathing systems for providing physiologically acceptable breathing gas from onboard oxygen generators to pilots and crew members of aircraft that fly at high altitudes. More particularly, this invention relates to an automatic system that monitors the status of the onboard oxygen generator, cabin altitude and stand-by oxygen supply and automatically provides physiologically acceptable breathing gas (generator product gas, stand-by oxygen or cabin air) to a breathing mask worn by a pilot or crew member.

BACKGROUND ART

It is well-known that the partial pressure of oxygen in the atmosphere decreases with altitude. For this reason it is necessary to provide the pilot and crew of high altitude aircraft with breathing systems in order to prevent hypoxia at high altitudes. Some of such breathing systems involve the generation of oxygen onboard the aircraft. Such systems may, for example, utilize bleed air from the aircraft engine(s), wherein such bleed air is processed to produce a product gas of high oxygen content. At certain altitudes, or during certain maneuvers, or in the event of malfunction, the onboard generating system may not provide physiologically acceptable breathing gas. For this reason, most aircraft breathing systems utilizing onboard oxygen generating systems also utilize a stand-by supply of oxygen.

In breathing systems of the above-described type, breathing gas is provided to the pilot and crew members by breathing masks worn on their faces. The problem with this type of system is that a breathing mask typically prevents the wearer from breathing ambient or cabin air unless the mask is removed from the wearer's face. Thus, once the mask is in position on the face, the wearer must make use of the aircraft breathing system. In most cases, the onboard oxygen generating system does not become operative until the aircraft engines are turned on. Therefore, a pilot or crew member wearing a breathing mask in an aircraft cockpit before the engines are running typically must use the stand-by supply of oxygen. This results in an unnecessary depletion of the stand-by supply which also causes high logistic and maintenance requirements. To prevent stand-by supply depletion, the crew member may elect to let his mask hang and breathe ambient air. This is undesirable because it may result in a loss of communications. Breathing masks typically include an intercom system for pilot and crew communication. When the pilot or crew member lets the mask hang, the intercom usually must be turned off because of intercom noise pickup resulting from the hanging mask.

Many high altitude aircraft also have the capability of permitting pilot and crew ejection. An oxygen supply is required if it should become necessary to eject at a high altitude. Therefore, aircraft with ejection provisions also incorporate a bail out (or emergency) oxygen supply. In other words, the emergency oxygen supply ejects along with the crew. The emergency oxygen supply is usually in the form of an oxygen bottle mounted to the aircraft seat. In aircraft having either separate stand-by and emergency supplies, or combined stand-by/emergency supplies, depletion of the stand-by/emergency supply bottle during normal operations is not desirable from a logistics, maintenance, and operational usage standpoint.

The present invention provides an improved breathing system that addresses (a) the above-stated problem of inefficient utilization of stand-by oxygen, (b) provides a method of integrating the various supplies along with cabin air breathing provisions and (c) presents an automatic control method to minimize crew work load. Means to replenish stand-by oxygen to reduce logistics and maintenance are also disclosed. Prior art United States patents which are known to be pertinent to the present invention are as follows: Price, U.S. Pat. No. 2,582,848 issued on Jan. 15, 1952; Summers, U.S. Pat. No. 2,877,966 issued on Mar. 17, 1959; Turek, U.S. Pat. No. 3,215,057 issued on Nov. 2, 1965; Jackson, U.S. Pat. No. 3,410,191 issued on Nov. 12, 1968; Wachter, U.S. Pat. No. 3,425,333 issued on Feb. 4, 1969; O'Reilly et al, U.S. Pat. No. 3,500,827 issued on Mar. 17, 1970; Reiher, U.S. Pat. No. 3,593,735 issued on July 20, 1971; Cramer et al, U.S. Pat. No. 3,720,501 issued on Mar. 13, 1973; Vensel, U.S. Pat. No. 4,057,205 issued on Nov. 8, 1977; and Cronin et al, U.S. Pat. No. 4,419,926 issued on Dec. 13, 1983.

DISCLOSURE OF THE INVENTION

This invention provides a breathing system for supplying physiologically acceptable breathing gas to a pilot and/or crew of an aircraft. The system includes a breathing mask, a pressure regulator that includes a means for connecting the regulator to the mask, and a means for supplying breathing gas to the regulator. The breathing gas supply means supplies breathing gas to the regulator at a feed pressure and oxygen partial pressure generally acceptable and adequate for prevention of hypoxia. The connecting means connects the regulator to the mask so that breathing gas may be communicated from the regulator to the mask. The regulator regulates the breathing gas pressure to a level that is acceptable for breathing by the pilot or crew.

Also included in the system is a means for providing ambient or cabin air to the breathing mask. The ambient air means is responsive to the feed pressure of the breathing gas fed to the regulator from the supply means. When the feed pressure of the breathing gas falls below a certain pressure value, the ambient air means provides ambient air to the breathing mask.

The breathing gas supply means may include a means for generating breathing gas onboard the aircraft, and a means for providing a stand-by supply of breathing gas. A selector valve, which normally is connected to both the breathing gas generating means and the stand-by supply means during aircraft flight, receives breathing gas from each of these two breathing gas supply sources. The selector valve is also connected to the pressure regulator in a manner so that the selector valve may feed breathing gas to the regulator from either of the two sources. The selector valve is operable to permit breathing gas to be fed to the regulator from only one of the two sources at any one time. In other words, the selector valve is controlled to select breathing gas from either the onboard generating means, or the standby supply means. The gas from such selected source is fed into the regulator which is then communicated onward to the breathing mask.

The selector valve may be connected to the generator means and to the stand-by supply means by a first and a second airflow passageway, respectively. A third airflow passageway may be provided for connecting the selector valve to the regulator. When the selector valve is operated to select breathing gas from one of the two supply sources, i.e., either the generating means or the stand-by supply means, the selector valve is operated to communicate breathing gas from one of the first and second passageways into the third passageway.

The breathing system of the present case also includes another source (emergency supply) means for providing breathing gas to the mask that is separate from the onboard generating means and the stand-by supply means. The emergency breathing gas received therefrom is feedable to the regulator when the generating means and the stand-by supply means are disconnected from the selector valve. This emergency supply means is included in the breathing system primarily as a source of breathing gas after pilot ejection from the aircraft. However, the emergency supply means may also be utilized as a back up system in the event that both the onboard generating means and the stand-by supply means should malfunction for some reason.

The emergency supply means may include an emergency airflow passageway for connecting the emergency supply means to the third airflow passageway that connects the selector value to the regulator. This connection permits the emergency supply means to supply breathing gas to the third passageway at a feed pressure within a range of feed pressures, which is then communicated to the regulator.

The ambient airflow means may be in the form of an ambient airflow passageway connected to the breathing mask. A valve means is positioned in the ambient airflow passageway for blocking or permitting ambient air to flow from the ambient environment to the breathing mask. The valve means is responsive to the pressure of breathing gas fed to the regulator. The valve means responds to the feed pressure in a manner so that if the feed pressure has a value below a certain pressure value, the valve means permits ambient airflow to the breathing mask. If, however, the feed pressure has a value equal to or greater than the certain pressure value, then the valve means blocks the ambient airflow passageway.

The valve means may include a bypass valve positioned in the ambient airflow passageway for blocking or permitting airflow therein. The bypass valve may be connected to the third airflow passageway in a manner so that the bypass valve is operated by the feed pressure in the third passageway.

The various airflow passageways in the breathing system may include several one-way check valves that prevent back flow in the system. For example, a first one-way check valve may be positioned in the emergency airflow passageway for the purpose of permitting emergency breathing gas to flow only in a direction from the emergency supply means to the third passageway. A second one-way check valve may be positioned in the third passageway for permitting breathing gas to flow only in a direction from the selector valve to the regulator. This second check valve must be positioned in the third passageway so as to permit the bypass valve to be responsive to breathing gas feed pressure in the third passageway, however. A third one-way check valve may be positioned in the ambient airflow passageway between the position of the bypass valve in such passageway and the breathing mask. The third check valve would be operable to permit ambient air to flow only in a direction from the position of the bypass valve to the breathing mask.

An automatic control means may be provided for selecting breathing gas from any one of the three breathing gas sources described herein above, i.e., the onboard oxygen generating means, the stand-by supply means, and the emergency supply means. During normal operation of the system, the generating means may provide breathing gas to the selector valve at pressures and oxygen partial pressures that vary according to a designed schedule that is a function of cabin or aircraft altitude. The stand-by supply means may be in the form of a reservoir of stored breathing gas, such as an oxygen bottle, for example. Therefore, the pressure of breathing gas supplied by the stand-by supply means may also vary, but in accordance with the residual contents of the reservoir or bottle. The automatic control means normally operates the selector valve to select breathing gas from one of these two breathing gas sources by monitoring and responding to the sensed pressures of the onboard oxygen generating means and the stand-by supply, including oxygen partial pressure provided by the onboard generating means, and the altitude of the aircraft cabin. In preferred form, the control means operates the selector valve to cause it to select breathing gas from the generator means when the pressure of its product gas including oxygen partial pressure are higher than preselected values, and when the cabin of the aircraft is below a preselected high altitude. For example, the control means may cause the selection of generated breathing gas when the pressure of such gas is at least as high as 10 psig, with the oxygen partial pressure being greater than the pressure required to prevent hypoxia, and when the altitude of the cabin is below 25,000 feet. If, on the other hand, the altitude of the cabin is greater than the preselected high altitude, the control means switches to standby and then compares the relative breathing gas pressure supplied by the onboard generating means and the stand-by supply means. If the higher pressure is from the generator means the control means switches back to the onboard generator means.

A mode selector means may be provided for the purpose of giving the aircraft pilot a means for overriding the automatic control means. The pilot can operate the mode selector means to cause the selector valve to be operated to select breathing gas only from the stand-by supply means, regardless of cabin altitude or the onboard oxygen generator means product gas pressure which includes its oxygen product gas partial pressure. The mode selector means may include a stand-by supply valve positioned in the second airflow passageway and operable to be opened or closed to permit breathing gas flow communication in such passageway. Activation of the mode selector means operates the selector valve to cause it to select breathing gas only from the second passageway, and also opens the stand-by supply valve so that airflow communication is permitted in the second airflow passageway.

Also positioned in the second passageway may be an aneroid valve. The aneroid valve may be responsive to cabin altitude so that it blocks airflow in the second airflow passageway when the cabin is at an altitude below a certain preselected low altitude. For example, the aneroid valve may be operable to block the second passageway when the cabin altitude is less than 9,000 feet. When the altitude is higher, the aneroid valve opens automatically to permit airflow in the second passageway.

The aneroid valve is positioned in the second passageway in parallel airflow relationship to the stand-by supply valve, which is operated by the mode selector means. This parallel airflow relationship permits the stand-by supply valve to be opened at any altitude to permit breathing gas communication from the stand-by supply means to the selector valve. Therefore, the aneroid valve cannot block the second passageway when the stand-by supply valve is opened manually at any altitude.

Similar to the stand-by supply means, the emergency supply means may also be in the form of a breathing gas storage reservoir, such as an oxygen bottle or cylinder. If it is in the form of an oxygen bottle, for example, it may be connected to the third airflow passageway by an emergency airflow passageway. Positioned in the emergency airflow passageway would be an emergency oxygen control valve. This control valve would be operable to be opened to permit the flow of emergency oxygen into the third passageway. Such valve may be operated by the automatic control means and actuated during seat ejection, or it may be operated manually.

The stand-by supply means or stand-by supply cylinder may be connected to the second passageway with a stand-by oxygen control valve being placed in operative position between the stand-by supply and the second passageway. This stand-by oxygen valve may be opened to permit the flow of stand-by breathing gas into the second passageway from the stand-by storage cylinder. The pressure of the breathing gas provided by the stand-by storage cylinder, as was explained above, may vary in accordance with the contents of the cylinder. A plurality of chemical oxygen generators, each of which can chemically generate oxygen, and each of which is connected to the storage cylinder for communicating chemically generated oxygen to the cylinder, may be provided for replenishing the supply of stand-by oxygen in the storage cylinder. A sequencing means would be included for operating the plurality of chemical oxygen generators in a preselected sequence to chemically generate additional oxygen as may be needed in response to the variation of oxygen pressure in the cylinder.

The chemical oxygen generators may be replaced by a compressor. A first means may be provided for sensing gas pressure in the storage cylinder, and for causing the onboard oxygen generating means to generate gas at a high oxygen concentration when the gas pressure in the storage cylinder drops below a designated pressure value. A feed means would then feed the generated high oxygen content product gas to the compressor where it would be compressed. A means for connecting the compressor to the stand-by storage cylinder would be provided so that the compressed gas could be fed into the storage cylinder, to increase the pressure of gas stored therein to a preselected pressure. On achieving the preselected pressure, the onboard oxygen generating system would return back to its normal operation and the compressor would stop functioning.

An advantage to a breathing system constructed in accordance with the present invention is that it provides a stand-by source of breathing gas or oxygen to a pilot or crew in the event of a malfunction of the onboard generating system without compromising the integrity of the breathing system during and after pilot ejection.

Another advantage of a breathing system constructed in accordance with the present invention is that it provides the pilot or crew with a means for breathing ambient or cabin air on the ground while wearing a mask when the onboard generating means is inoperative due to unavailability of electrical power or engine bleed air. It also permits the pilot or crew to conserve oxygen stored in the stand-by supply means when flying at low altitudes with a failed or malfunctioning onboard oxygen generating system because cabin air can be breathed through the mask.

Still another advantage of a breathing system constructed in accordance with the present invention is that the present invention provides a means for automatically selecting breathing gas from the various available sources, i.e., ambient air, onboard generating means, or stand-by or emergency supply means. Having automatic selection and control minimizes pilot or crew work load. Automatic control also maximizes the efficient use of the stand-by supply of oxygen.

These advantages and others will become apparent to the reader upon reading the following description of the invention in conjunction with the included drawings.

BRIEF DESCRIPTION OF THE DRAWINGS

With reference to the drawings, like reference numerals refer to like parts throughout the various views, and wherein.

BEST MODE FOR CARRYING OUT THE INVENTION

Figure 1:
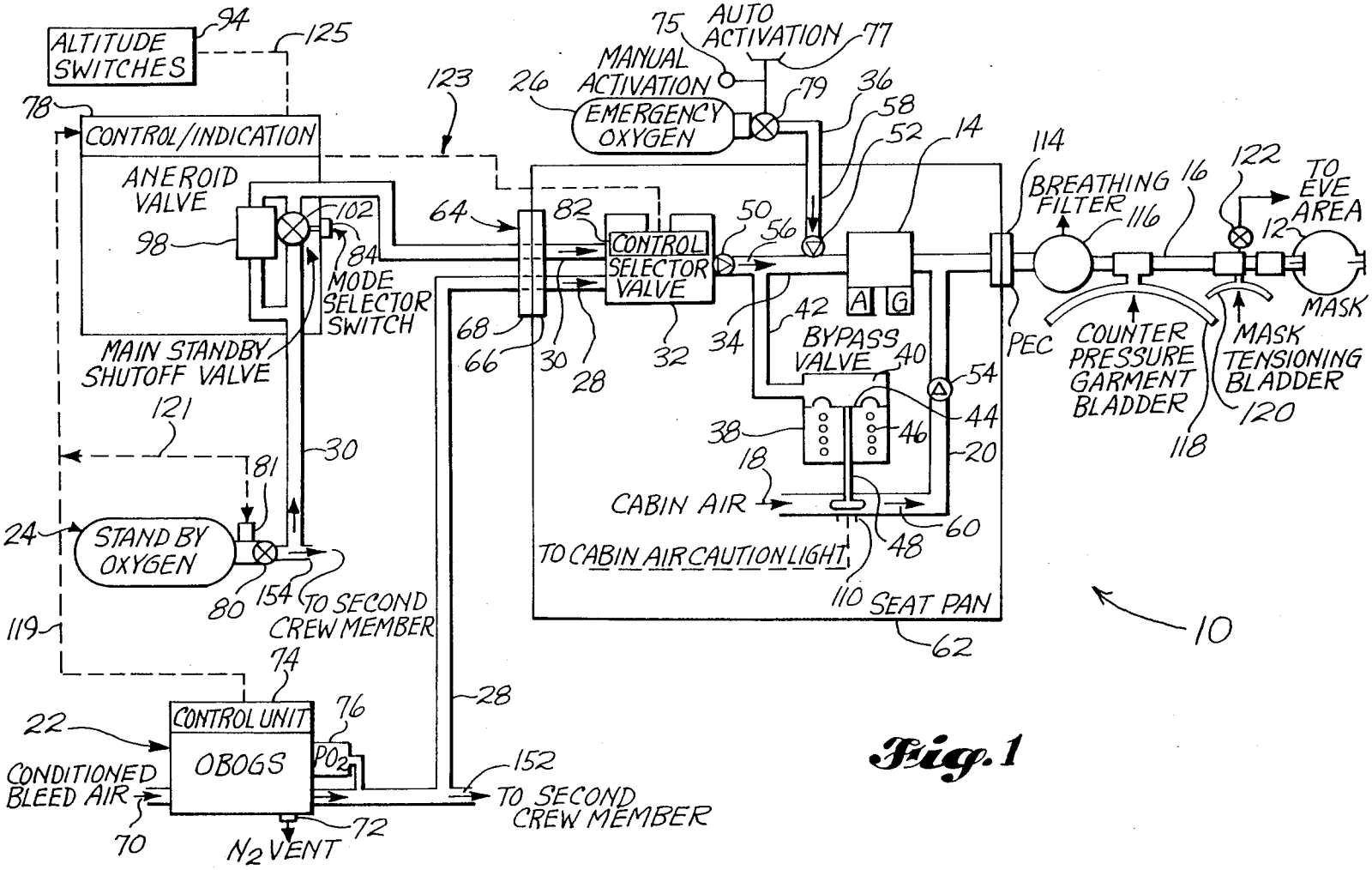
FIG. 1 is a schematic view of a breathing system constructed in accordance with the present invention.

Referring now to the drawings, and first to FIG. 1, therein is shown a breathing system 10 constructed in accordance with a preferred embodiment of the present invention. The system 10 provides physiologically acceptable breathing gas (oxygen partial pressure greater than that required to prevent hypoxia) to an aircraft pilot or crew. For the purpose of this description, the breathing system 10 will be described in the context of use by a pilot in a single seat aircraft. It should be appreciated, however, that the system 10 may be implemented for use by multiple crew members aboard an aircraft.

The breathing gas is delivered to the pilot by means of a mask 12 that is worn on the pilot's face. The mask 12 is connected to a pressure regulator 14 by a duct 16.

Breathing gas is supplied to the regulator at a feed pressure within a range of regulator design feed pressures. The manner by which breathing gas is supplied will be further explained at a later point in this description. The regulator 14 regulates the breathing gas feed pressure, and the regulated gas is delivered through duct 16 to the mask 12.

Breathing gas may also be delivered to the mask 12 from the ambient environment surrounding the pilot. In most cases the ambient environment will consist of cabin air in the aircraft cockpit. Ambient or cabin air, indicated generally by arrow 18, is delivered to the mask 12 by means of a duct 20 that is connected to duct 16. The flow of ambient air 18 in duct 20 is controlled by the breathing gas feed pressure as it is fed to the regulator 14. The control of ambient airflow in duct 20 will be described later herein.

In preferred form, breathing gas is fed to the regulator 14 from either an onboard oxygen generating system (OBOGS) 22, or a stand-by oxygen supply 24. Breathing gas may also be fed to the regulator 14 from an emergency oxygen supply 26. The OBOGS 22 supplies breathing gas to the regulator by means of a first airflow passageway or duct 28. In a similar fashion, the stand-by oxygen supply 24 provides breathing gas to the regulator 14 by means of a second airflow passageway or duct 30.

The first and second airflow ducts 28, 30 first deliver breathing gas to a selector valve 32. The selector valve 32 is operable to select breathing gas from only one of the two supplies, i.e., the OBOGS 22 or the stand-by oxygen supply 24. After such selection is made, the selector valve 32 communicates breathing gas from the selected source into a third airflow passageway or duct 34. This third duct 34 connects the selector valve to the regulator 14. Therefore, the selector valve provides a gas flow connection from one of the first and second ducts 28, 30 to the third duct 34.

The emergency oxygen supply 26 is also connected to the third airflow duct 34 by means of an emergency oxygen supply passageway or duct 36. Thus, the regulator 14 receives breathing gas from the third duct 34, with such gas being provided by any one of three possible breathing gas sources.

Ambient air 18 may be supplied through the duct 20 in response to breathing gas feed pressure in the third duct 34. In preferred form, a bypass valve 38 is positioned in the ambient airflow duct 20 for the purpose of permitting or blocking airflow therein depending on the feed pressure in duct 34. By way of example only, the bypass valve 38 may include a variably expansible gas chamber 40 that is connected to the third duct 34 by a bypass response duct 42. The bypass response duct 42 communicates breathing gas feed pressure from the duct 34 into the chamber 40. Inside the bypass valve 38 may be a movable piston 44 and a spring 46. The volume of the chamber 40 changes according to the feed pressure in duct 34 and the piston 44 moves in accordance with such change. The piston 44 is connected to a member 48 that controls the opening and closing of a port in the ambient airflow duct 20 (the port is not shown in the drawings).

The position of the piston 44 in the bypass valve 38 depends on the pressure in the duct 34. In preferred form, the spring 46 is normally in a state of compression. Therefore, if the pressure in duct 34 drops below a certain preselected pressure value, the force in the spring 46 causes the piston 44 to move so that the volume of chamber 40 is made smaller. This in turn causes the member 48 to open the port in the ambient airflow duct 20. When the feed pressure in duct 34 is above the preselected value, the volume of the bypass valve chamber 40 is in an expanded state, thereby compressing the spring 46, and causing member 48 to keep the port closed. If none of the sources of breathing gas, i.e., the OBOGS 22, the stand-by oxygen supply 24, and the emergency oxygen supply 26, provide breathing gas to the regulator 14, then there will be an insufficient feed pressure in duct 34 to operate the bypass valve 38 to keep the port closed. Without sufficient feed pressure, bypass valve 38 will open thereby permitting the flow 60 of ambient air 18 through the ambient airflow duct 20 and on into the mask 12.

Positioned in the airflow ducts 34, 36 and 20 are one-way check valves 50, 52 and 54. The check valve 50 is flow biased so that it will permit gas to flow only from the selector valve 32 to the regulator 14 in the direction indicated by arrow 56. In similar fashion, the check valve 52 is biased to permit gas to flow only in a direction from the emergency oxygen supply to the duct 34 in the direction indicated by arrow 58. The purpose of the check valves 50, 52 is to prevent reverse airflow from the duct 34 back to any one of the breathing gas supply sources 22, 24, 26. For a similar reason, the check valve 54 in the ambient airflow duct 20 permits air to flow only from the ambient environment to the mask in the direction indicated by arrow 60.

The breathing system 10 shown in FIG. 1 is well suited for use in a high altitude aircraft having pilot ejection capability. In preferred form, the regulator 14, the selector valve 32, the ambient airflow duct 20, the emergency oxygen supply 26, and the ducts 34, 42, 36 interconnecting various breathing system components may all be mounted in an aircraft seat pan 62 or on an aircraft seat. FIG. 1 schematically shows a seat pan installation. An airplane seat receptacle 64 is provided for disconnecting the OBOGS 22 and the stand-by oxygen supply 24 from the selector valve when the pilot ejects. The seat receptacle 64 may include, for example, a first portion 66 and a second portion 68. Upon pilot ejection, the first and second portions separate, with the first portion remaining connected to the seat pan 62.

Prior to ejection and during normal flight, breathing gas is supplied to the pilot from the OBOGS 22. A person skilled in the art would be familiar with OBOGS technology. By way of example only, the OBOGS 22 may utilize conditioned bleed-air received from an aircraft engine. This is indicated generally by arrow 70 in FIG. 1. The OBOGS 22 generates oxygen enriched product gas which is communicated into the first airflow passageway 28. Oxygen depleted air may be exhausted overboard from the OBOGS 22 by a vent 72. The OBOGS 22 may include a controller unit 74 that operates the OBOGS 22 to cause it to provide physiologically acceptable breathing gas as a function of cabin altitude. The OBOGS 22 may include an oxygen partial pressure sensor 76, connected to the duct 28, which may be used in the overall control and warning system of the entire breathing system 10. Such control will be described later herein.

Upon or after ejection, the emergency oxygen supply 26 may then be activated to supply breathing gas to the duct 34. The one-way check valve 50 in duct 34 prevents breathing gas supplied by the emergency oxygen supply from exiting through the selector valve into ducts 28, 30, which will be open after the first and second portions 66, 68 of the receptacle 66 separate.

Generally, the breathing system 10 is controlled so that the selector valve 32 selects breathing gas from the OBOGS 22 for as long as the OBOGS can supply physiologically acceptable breathing gas. There may be various reasons why the OBOGS 22 cannot adequately perform this function. For example, when the aircraft is flying at extremely high altitudes the bleed air available from the aircraft engine(s) may not be at sufficient conditions to be processed by the OBOGS 22 to generate gas of desired oxygen partial pressure or pressures within the selected design feed pressures. In such a situation, the selector valve 32 would be operated to automatically select breathing gas from the stand-by supply 24 as an alternative to the OBOGS 22. If for some reason the OBOGS 22 and the stand-by oxygen supply 24 should both fail to provide breathing gas, then the emergency oxygen supply 26 could be used to supply breathing gas to the regulator 14 by a manual activation means 75 which opens a pressure regulating and emergency control valve 79.

As was mentioned above, in the event of pilot ejection, the stand-by supply 24 and the OBOGS 22 are disconnected from the selector valve 32 (by means of separation of the seat receptacle 66). The emergency oxygen supply 26, which ejects along with the pilot's seat, would then be automatically activated to supply breathing gas to the pilot. An automatic activation means 77 would be provided for opening the pressure regulating and emergency control valve 79, thereby permitting emergency oxygen to be supplied to the regulator 14.

The breathing system 10 may be controlled by a micro-processor or a control circuit which is indicated schematically by block 78 in FIG. 1. The control circuit 78 will hereinafter be referred to as a controller 78. In addition to controlling the breathing system 10, the controller 78 also provides signals to a control and indication panel 83 (see FIG. 2) indicating which of the breathing gas sources is in use.

The OBOGS 22 may provide breathing gas to the selector valve 32 at a feed pressure and oxygen partial pressure that varies according to cabin altitude. The stand-by oxygen supply 24 may be in the form of an oxygen bottle wherein the pressure of breathing gas supplied thereby decreases with depletion of bottle contents. The controller 78 monitors the breathing gas feed pressure and oxygen partial pressure from the OBOGS 22, and the pressure from the stand-by oxygen supply 24. Depending on the pressure values, the controller 78 causes the selector valve 32 to select breathing gas from one of the two sources. By way of example only, the control circuit 78 may monitor the partial pressure of the product gas provided by the OBOGS 22 by means of the partial pressure oxygen sensor 76. The sensor 76 indicates to the controller 78 whether or not the breathing gas available from the OBOGS 22 is of required oxygen partial pressure content to prevent hypoxia. If this is the case, then the controller 78 sends a signal to a selector valve control circuit 82 that causes the selector valve 32 to select breathing gas from the first airflow duct 28. The controller 78 also monitors the pressure of the stand-by supply 24. If the OBOGS 22 is not providing physiologically acceptable breathing gas, and if there is sufficient pressure in the stand-by supply 24, then the controller 78 sends a signal to the selector valve control 82 causing the selector valve 32 to select breathing gas from the stand-by supply 24. Breathing gas supplied by the stand-by supply 24 may be pressure regulated by a valve 80 connecting the stand-by supply to the duct 30. A pressure transmitter 126, connected to the stand-by supply 24, provides a bottle pressure signal to the controller 78, and to the pressure gage 104 in FIG. 2.

In addition to responding to breathing gas and oxygen partial pressure of the OBOGS 22, and to the pressure of the stand-by oxygen supply 24, the controller 78 may also operate in response to cabin altitude. For example, the selector valve 32 may be controlled to select breathing gas from the stand-by oxygen supply 24 when the cabin is above a given preselected altitude. By way of explanation only, the controller 78 may be responsive to a preselected cabin altitude of 25,000 feet. If the cabin altitude is greater than 25,000 feet, and if the pressure of the stand-by oxygen supply 24 is greater than a designed pressure threshold, then the controller 78 may cause the selector valve 32 to select breathing gas from the stand-by oxygen supply irrespective of the performance of the OBOGS 22. If, on the other hand, the pressure of the stand-by supply is less than the designed pressure threshold, then the controller 78 may cause the selector valve to select breathing gas from the OBOGS 22 even if the cabin altitude is greater than 25,000 feet.

Figure 3:
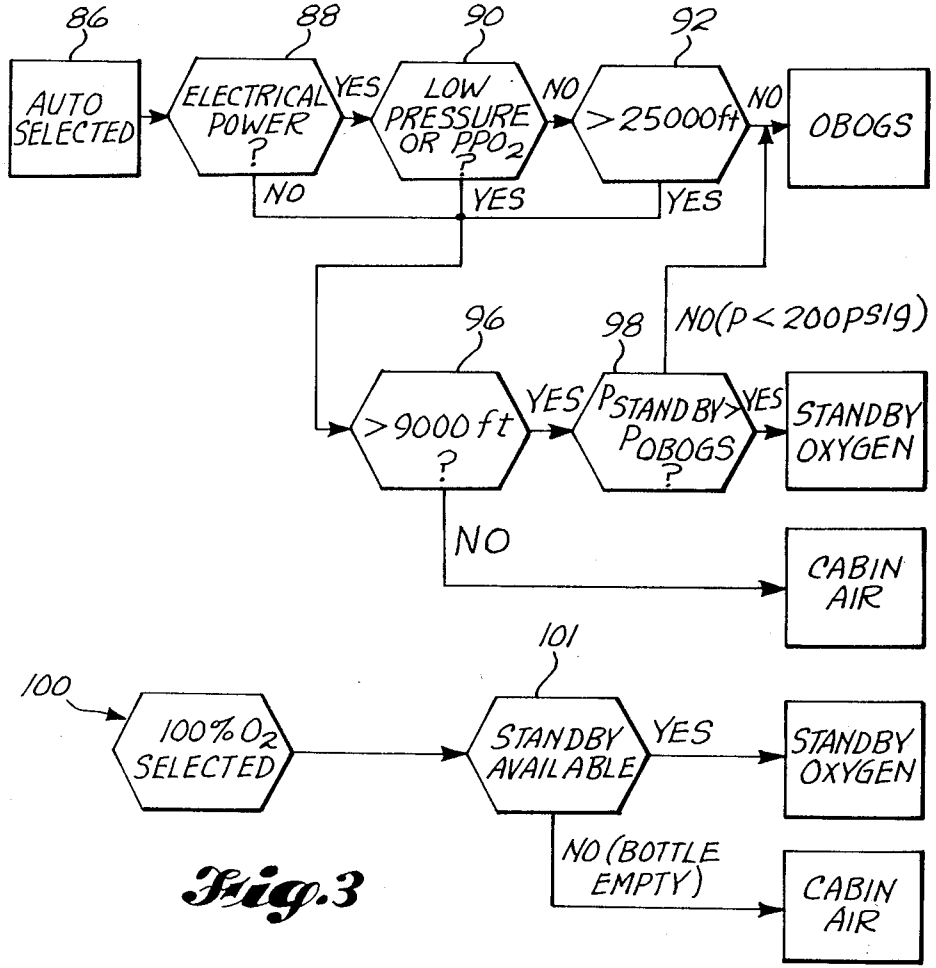
FIG. 3 is a schematic flow chart showing the control logic for a breathing system constructed in accordance with the present invention.
Figure 2:
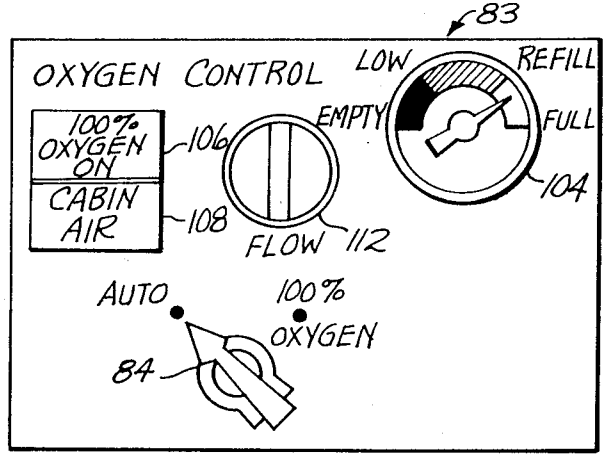
FIG. 2 is a pictorial frontal view of a control panel in an aircraft cockpit, and showing the controls for a breathing system constructed in accordance with the present invention.

Referring now to FIG. 3, preferred control logic for the controller 78 will now be explained. An advantage of the present invention is that it provides a pilot or crew of an aircraft with simple breathing system control. The pilot has the option of either permitting the controller 78 to automatically control the breathing system, or the pilot can manually select the stand-by supply of oxygen 24. The stand-by supply would most likely be gas of high oxygen content (100% oxygen). Referring now to FIG. 2, therein is shown a preferred embodiment of a control panel 83 that a pilot may see in the aircraft cockpit. A switch 84 provides the choice between selecting automatic control or 100% oxygen (stand-by). The switch 84 as shown in FIG. 2 is positioned to select automatic control.

Indicated generally by arrow 86 in FIG. 3 is the logic flow chart for the automatic control of the breathing system 10. When automatic control is selected, the first step 88 taken by the controller 78 is to determine if electrical power is being supplied to the OBOGS 22 for operation of the OBOGS. In preferred form, the OBOGS 22 will be hard wired to the aircraft power bus. What this means is that activation of no switches will be required to power the OBOGS 22 when the aircraft power bus is energized. Electrical power is supplied automatically to the OBOGS 22 when the power bus is energized. If the controller 78 determines that electrical power is in fact being supplied to the OBOGS 22, then the second logic step 90 taken by the controller 78 is to determine the pressure and oxygen partial pressure of the breathing gas output from the OBOGS. If the OBOGS is outputting breathing gas at an acceptable pressure, (by way of example, above 10 psig), and a physiologically acceptable oxygen partial pressure, then the third step 92 taken by the controller 78 is to check the altitude of the cabin. The cabin altitude signal may be provided by an altitude switch 94 (see FIG. 1) connected to the controller 78. If the altitude of the aircraft is below 25,000 feet, and the steps 88 and 90 are successful, the controller 78 will then send a signal to the selector valve control circuit 82, to cause it to operate the valve 32 to select breathing gas from the OBOGS system 22.

If electrical power is not available, or the pressure output of the OBOGS 22 is low (below 10 psig, for example), or the oxygen partial pressure is low, the controller 78 causes the selector value 82 to select stand-by oxygen. Flow of stand-by oxygen depends on an aneroid valve 98 positioned in the second duct 30. The aneroid valve 98 is normally closed and opens only when the cabin altitude is higher than a preselected altitude threshold. In preferred form, such preselected altitude may be 9,000 feet. For example, if the altitude of the cabin is below 9,000 feet (step 96), then the aneroid valve 98 remains closed and no breathing gas may be delivered from the stand-by oxygen supply 24 to the selector valve 32. What this means is that the system automatically allows the pilot to breathe cabin air which is physiologically acceptable at low cabin altitudes. This has the advantage that (a) it conserves stand-by oxygen for future use at high cabin altitudes, (b) allows the pilot to breathe cabin air without removal of the mask, and (c) reduces stand-by oxygen system logistics and maintenance.

If the aircraft altitude is above the preselected altitude threshold (9,000 feet), then the aneroid value 98 is open and breathing gas may be supplied from the stand-by oxygen supply 24. As a next step 98 the controller 78 compares the output pressure of the stand-by oxygen supply 24 with the output pressure of the OBOGS 22. Whichever source provides the higher output pressure is selected by the controller 78. As can be seen from the logic diagram of FIG. 3, even if the cabin altitude of the aircraft is greater than 25,000 feet, as long as the pressure output of the OBOGS 22 is greater than the pressure output of the stand-by oxygen supply 24, then the OBOGS will be selected by the controller 78.

To summarize the control circuit operation, the controller 78 is preferably designed to operate the breathing system 10 so that the pilot may breathe cabin air when the aircraft is on the ground and when the engines are not running. This eliminates unnecessary depletion of stand-by oxygen from the stand-by supply 24. The only other time the pilot may breathe cabin air is if for some reason the OBOGS 22 should malfunction when the cabin is still at an altitude below the preselected cabin altitude. At all other times during normal flight the controller 78 selects the OBOGS as a source of breathing gas. In the event of OBOGS malfunction at high cabin altitude (greater than 9,000 feet) or cabin depressurization (cabin altitude greater than 25,000 feet) the system automatically selects stand-by oxygen system 24 and maintains stand-by oxygen supply until the stand-by oxygen supply is depleted. After total stand-by oxygen depletion, the system automatically selects the OBOGS for all conditions, except OBOGS shut down. For OBOGS shut down the controller 78 selects cabin air. Such automatic control at all times leaves the pilot free to tend to other tasks.

The switch 84 on the control panel 83 (see FIG. 2) provides the pilot with a mode selector control means for overriding the automatic controller 78. If the position of the switch 84 is changed, breathing gas from the stand-by oxygen supply will be selected regardless of aircraft altitude or OBOGS 22 output. In such case, the flow chart indicated generally by arrow 100 in FIG. 3 illustrates the operation of the breathing system 10.

Selecting the mode control override causes the selector valve 32 to receive oxygen from the stand-by oxygen source 24. A main stand-by shut-off valve 102 is positioned in the second airflow duct 30 in parallel airflow relationship to the aneroid valve 98. If 100% oxygen is selected on control panel 83, the main stand-by shut-off valve 102 is opened permitting oxygen to flow from the stand-by oxygen supply to the selector valve 32, and the selector control 82 operates the selector valve 32 to select stand-by oxygen from the second duct 30. Such flow is permitted even if the cabin altitude is below the pre-selected cabin altitude threshold (9,000 feet). What this means is that the aneroid valve 98 cannot block breathing gas flow in the duct 30 if 100% oxygen is selected by the pilot at an altitude above or below the preselected cabin altitude threshold.

Referring again to FIG. 3, once 100% oxygen has been selected, if a stand-by supply of oxygen is available (step 101) from the stand-by source 24, then the pilot breathes 100% oxygen until he places the breathing system back under automatic control. If a stand-by supply is not available (stand-by oxygen bottle empty) then the bypass valve 38 responds to low feed pressure in the third duct 34 and opens the ambient airflow duct 20. In FIG. 2, the control panel 83 may be provided with a pressure gauge 104 indicating to the pilot the amount of oxygen available from the stand-by oxygen supply 24. Warning lights 106 and 108 may be provided to indicate to the pilot the source of breathing gas. A sensor 110 may be connected to the bypass valve 38 to turn on the cabin air light 108 when the bypass valve permits ambient airflow in duct 20. Other caution and advisory lights may be added to the control panel 83 or other aircraft panels (e.g. caution lights display) to provide required system status or warnings.

A flow sensor may be connected to the selector valve 32 for indicating breathing gas airflow through the selector valve. The control panel 83 may have a flow sensor 112 for providing information to the pilot from the flow sensor.

The electrical connections between the controller 78 and the OBOGS 22 and stand-by oxygen supply 24 are indicated schematically in FIG. 1 by arrows 119 and 121. The electrical connection between the controller 78 and the selector valve control circuit 82 is indicated generally by arrow 123. Similarly, altitude information provided from altitude switch 94 to the controller 78 is indicated generally by arrow 125.

The various components and controls for the breathing system 10 as herein above described would be familiar to a person skilled in the art. A person skilled in the art would be able to construct control circuitry to control the breathing system 10 in the above-described manner from the logic diagram shown in FIG. 3.

Figure 4:
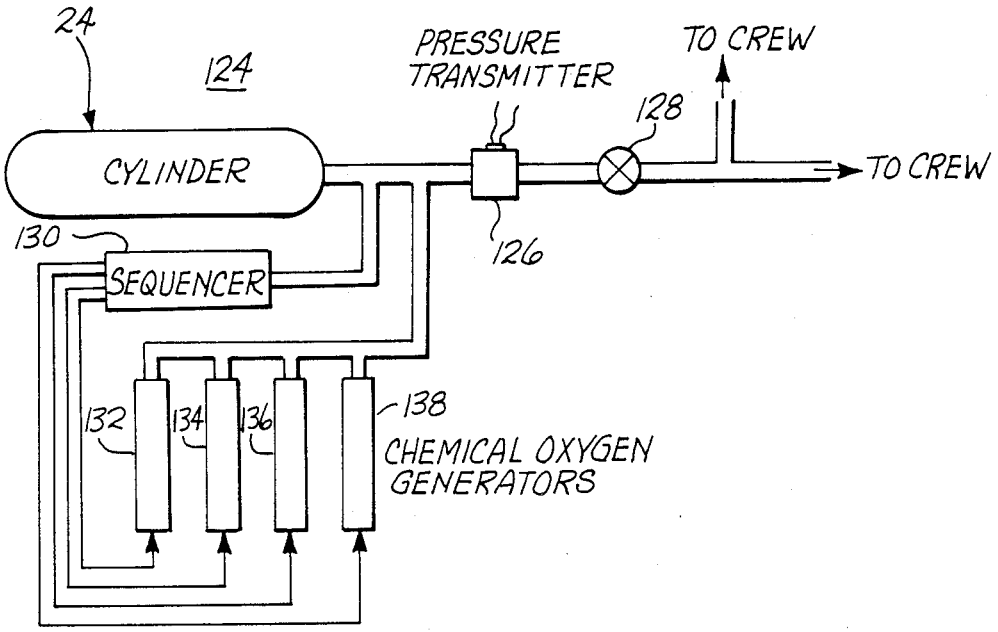
FIG. 4 is a schematic view of a stand-by oxygen supply system which may be used as a part of the breathing system shown in FIG. 1, and showing a plurality of chemical oxygen generators to be used for re-supplying oxygen to a gas storage cylinder.

Referring now to FIG. 4, therein is shown an alternative embodiment of a stand-by oxygen supply 24. The stand-by supply 24 includes a cylinder or bottle 124 for storing oxygen. Connected to the cylinder 124 is a pressure transmitter 126. A pressure regulating and shut-off valve 128 is provided for control of gas flow and pressure to the selector valve 32. The pressure transmitter 126 provides pressure information to the pressure gage 104 (FIG. 2), and may also provide information to other caution and warning devices (not shown). The sequencer 130 activates a plurality of chemical oxygen generators 132, 134, 136, and 138. As the pressure in the cylinder 124 drops, the sequencer 130 causes the chemical oxygen generators 132, 134, 135, 138 to be activated to recharge the cylinder 124. The chemical oxygen generators activate in sequence for steadily decreasing cylinder pressure. For example, the generators 132, 134, 136 and 138 may activate when the cylinder pressure drops below 500, 450, 400 and 350 psig, respectively.

Figure 5:
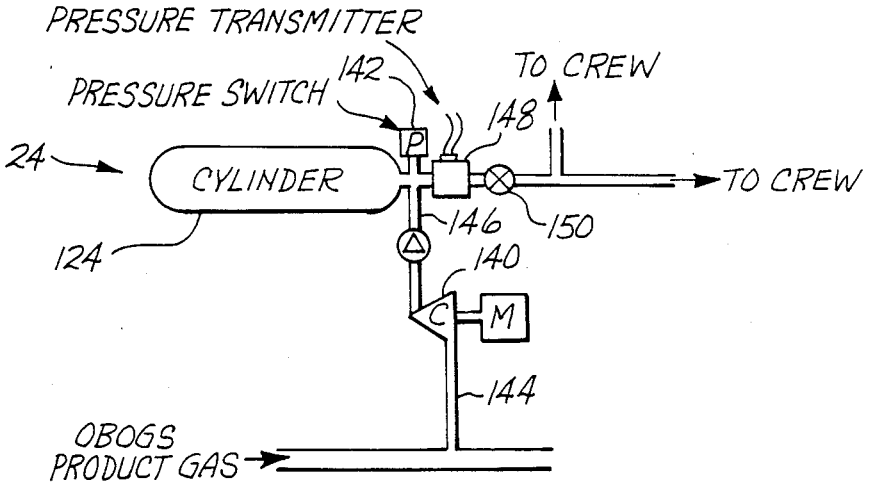
FIG. 5 is a schematic view of a stand-by oxygen supply system having the same purpose as the system shown in FIG. 4, but showing a compressor that feeds high oxygen content onboard oxygen generator product gas to the storage cylinder for the purpose of replenishing the supply of gas stored therein.

In another embodiment, shown in FIG. 5, the cylinder 124 is connected by a motor driven compressor 140 that receives OBOGS product gas. A pressure switch 142, connected to the cylinder 124, causes the OBOGS 22 to generate high oxygen (approximately 100%) product gas if the pressure of the stand-by cylinder 124 drops below a specified value (400 psig, for example). The OBOGS product gas is communicated by an airflow passageway 144 to the compressor 140. The compressor compresses the OBOGS product gas and transmits such compressed gas through a passageway 146 back to the cylinder 124. When the pressure switch senses that the cylinder 124 is pressurized to the desired value (500 psig, for example), the pressure switch 142 signals the OBOGS to stop generating high purity product gas and return to normal operation. A pressure regulating and shut-off valve 150 is also provided for connecting the cylinder 124 to the selector valve 32. The pressure transmitter 148 provides pressure information to the pressure gage 104 (FIG. 2) and may also provide information to other caution and warning devices (not shown). It would be apparent to those familiar in the art that this pressurization system reduces logistics and maintenance.

The duct 16 which connects the mask 12 to the regulator 14 may be connected to the seat pan 62 by a personal equipment connector (PEC) 114. Also connected in the duct 16 may be a breathing filter 116. The duct 16 may also provide regulated breathing gas to a counter pressure garment bladder 118, and a mask tensioning bladder 120. A demist or defog valve 122 may also be connected to the duct 16 for the purpose of providing defogging gas to the visor of a pilot's helmet.

The breathing system 10 is also suited for servicing more than one pilot or crew member of an aircraft. FIG. 1 shows secondary ducts 152 and 154, respectively, which may supply breathing gas from either the OBOGS 22 or the stand-by oxygen supply 24 to a second crew member. The second crew member would be provided with a breathing system that is a duplicate of the breathing system 10 shown in FIG. 1.

While an exemplary embodiment of this invention has been described above and shown in the accompanying drawings, it is to be understood that such embodiment is merely for illustrative purposes only. Obviously, certain changes may be made to the invention without departing from the spirit and scope thereof. It is intended that the scope of the invention shall be limited only by interpreting the appended claims which follow, in accordance with the well-established doctrines of patent claim interpretation.

What is claimed is:

1. A breathing system for supplying physiologically acceptable breathing gas to a pilot of an aircraft, the system comprising:

a breathing mask;

a pressure regulator;

means for supplying breathing gas to said regulator, said gas being supplied to said regulator at a feed pressure within a range of feed pressures;

means for connecting said regulator to said mask in a manner so that breathing gas may be communicated from said regulator to said mask, wherein said regulator regulates the pressure of said breathing gas communicated to said mask; and means for providing ambient air to said mask, said ambient air means being responsive to said feed pressure of said breathing gas, so that when said feed pressure has a value below a certain pressure value said ambient air means provides ambient air to said mask.

2. The breathing system in accordance with claim 1, wherein said means for supplying breathing gas includes:

means for generating breathing gas onboard the aircraft;

means for providing a stand-by supply of breathing gas; and a selector valve, normally connected to said generating means, and to said stand-by supply means, for receiving breathing gas from each of said means, with said selector valve being connected to said pressure regulator in a manner so that said valve may feed breathing gas to said regulator, and wherein said valve may be operable to permit breathing gas to be fed to said regulator from only one of said generating means and said stand-by supply means at any one time.

3. The breathing system in accordance with claim 2, including means for providing an emergency supply of breathing gas to said regulator.

4. The breathing system in accordance with claim 3, wherein said emergency supply means feeds emergency breathing gas to said regulator when said generating means and said stand-by supply means are disconnected from said selector valve.

5. The breathing system in accordance with claim 3, wherein said ambient air means includes an ambient airflow passageway connected to said mask, and a valve means positioned in said passageway, with said valve means being responsive to said breathing gas feed pressure, so that when said feed pressure has a value below said certain pressure value said valve means permits ambient air to flow in said passageway to said mask, but when said feed pressure has a value greater than said certain pressure value said valve means blocks said passageway to prevent the flow of ambient air to said mask.

6. The breathing system in accordance with claim 5, wherein said generating means provides breathing gas to said selector valve at a pressure and oxygen partial pressure that may vary according to aircraft altitude, and wherein said stand-by supply means may provide breathing gas to said selector valve from a reservoir of stored breathing gas, and wherein the pressure of breathing gas supplied by said stand-by means may vary, the breathing system further including:

automatic control means for operating said selector valve, with said control means being responsive to the pressure and oxygen partial pressure of breathing gas provided from said generating means to said selector valve, and being responsive to the pressure of breathing gas supplied by said stand-by supply means to said selector valve, and also being responsive to the altitude of the aircraft cabin, in a manner so that said control means causes said selector valve to select breathing gas from said generating means when the pressure of the breathing gas from said generating means is higher than a preselected pressure, and when the oxygen partial pressure is greater than that required to prevent hypoxia, and when the altitude of the cabin is below a preselected high-level altitude, and further, said control means causes said selector valve to select breathing gas from said stand-by supply means when said cabin is at an altitude above said preselected high-level altitude, and when said breathing gas pressure provided by said stand-by supply means is greater than said breathing gas pressure provided by said generating means at said preselected high-level altitude, but said control means causes said selector valve to select breathing gas from said generator means at cabin altitudes greater than said preselected cabin altitude when the breathing gas pressure provided by said stand-by supply means is less than the generating means supply pressure.

7. The breathing system in accordance with claim 6, including a mode selector means for overriding said automatic control means, to cause said selector valve to select breathing gas from said stand-by supply means regardless of cabin altitude and the breathing gas pressure and oxygen partial pressure provided by said generating means.

8. The breathing system in accordance with claim 5, wherein said generating means may be connected to said selector valve by a first airflow passageway, and said stand-by supply means may be connected to said selector valve by a second airflow passageway, and said selector valve may be connected to said regulator by a third airflow passageway, wherein said selector valve may be operable to select breathing gas from only one of said first and second passageways at any one time, and after such selection, said selector valve may feed breathing gas from the selected passageway into said third passageway, and with said emergency supply means including means for connecting said emergency supply means to said third passageway in a manner so that said emergency supply means may supply breathing gas to said third passageway, wherein said valve means includes a bypass valve connected to said third passageway in a manner so as to be responsive to the feed pressure therein, to permit ambient air to flow in said ambient airflow passageway when said feed pressure has a value below said certain pressure value, and to block said ambient airflow passageway to prevent the flow of ambient air to said mask when said feed pressure is higher then said certain pressure.

9. The breathing system in accordance with claim 8, wherein said generating means provides breathing gas to said selector valve at a pressure and oxygen partial pressure that may vary according to aircraft altitude, and wherein said stand-by supply means may provide breathing gas to said selector valve from a reservoir of stored breathing gas, and wherein the pressure of breathing gas supplied by said stand-by means may vary, the breathing system further including:

automatic control means for operating said selector valve, with said control means being responsive to the pressure and oxygen partial pressure of breathing gas provided from said generating means to said selector valve, and being responsive to the pressure of breathing gas supplied by said stand-by supply means to said selector valve, and also being responsive to the altitude of the aircraft cabin, in a manner so that said control means causes said selector valve to select breathing gas from said generating means when the pressure of the breathing gas from said generating means is higher than a preselected pressure, and when the oxygen partial pressure is greater than that required to prevent hypoxia, and when the altitude of the cabin is below a preselected high-level altitude, and further, said control means causes said selector valve to select breathing gas from said stand-by supply means when said cabin is at an altitude above said preselected high-level altitude, and when said breathing gas pressure provided by said stand-by supply means is greater than said breathing gas pressure provided by said generating means at said preselected high-level altitude, but said control means causes said selector valve to select breathing gas from said generator means at cabin altitudes greater than said preselected cabin altitude when the breathing gas pressure provided by said stand-by supply means is less than the generating means supply pressure.

10. The breathing system in accordance with claim 9, including a mode selector means for overriding said automatic control means, to cause said selector valve to select breathing gas from said stand-by supply means regardless of cabin altitude and the breathing gas pressure and oxygen partial pressure provided by said generating means.

11. The breathing system in accordance with claim 10, wherein said mode selector means includes a stand-by supply valve positioned in said second passageway, and operable in a manner so that when said mode selector means overrides said control means said stand-by supply valve permits breathing gas to be communicated in said second passageway from said stand-by supply means to said selector valve.

12. The breathing system in accordance with claim 11, including an aneroid valve positioned in said second passageway, said aneroid valve being responsive to the altitude of the cabin so that said aneroid valve blocks flow from said stand-by supply means to said selector valve when said cabin is at an altitude below a certain preselected low-level altitude, but said aneroid valve permits such flow when said aircraft is above said low-level altitude, and wherein said aneroid valve is positioned in said second passageway in parallel airflow relationship to said stand-by supply valve, said aneroid valve being positioned so that when said stand-by supply valve is operated at any altitude to permit breathing gas communication in said second passageway from said stand-by supply means to said selector valve said aneroid valve permits breathing gas communication in said second passageway.

13. The breathing system in accordance with claim 12, wherein said emergency supply means includes an emergency breathing gas storage cylinder, a control valve, and an emergency airflow passageway connecting said emergency storage cylinder to said third passageway, wherein said control valve is positioned in said emergency airflow passageway and is operable to be opened, to permit the flow of emergency breathing gas into said emergency airflow passageway and on into said third passageway.

14. The breathing system in accordance with claim 13, including a first one-way check valve positioned in said emergency airflow passageway for permitting emergency breathing gas to flow only in a direction from said emergency gas storage cylinder into said third passageway, and a second one-way check valve positioned in said third passageway for permitting breathing gas to flow only in a direction from said selector valve to said regulator, said second check valve also being positioned so as to permit said by-pass valve to be responsive to breathing gas feed pressure in said third passageway, and a third one-way check valve positioned in said ambient airflow passageway between the position of said by-pass valve and said mask, said third check valve permitting ambient air to flow only in a direction from said position of said by-pass valve to said mask.

15. The breathing system in accordance with claim 14, wherein said stand-by supply means includes a stand-by breathing gas storage cylinder connected to said second passageway, a stand-by control valve connected between said stand-by storage cylinder and said second passageway, wherein said stand-by control valve may be operated to be opened to permit the flow of stand-by breathing gas into said second passageway from said stand-by storage cylinder;

a plurality of chemical breathing gas generators, each of which is operable for chemically generating breathing gas, and each of which is connected to said storage cylinder for communicating such generated breathing gas to said cylinder; and sequencing means for operating said plurality of chemical gas generators in a preselected sequence, to chemically generate additional oxygen for said stand-by storage cylinder in response to the variation of gas pressure in such cylinder resulting from the supply of breathing gas by said stand-by supply means to said selector valve.

16. The breathing system in accordance with claim 14, wherein said stand-by supply means includes a stand-by breathing gas storage cylinder;

a compressor;

means for sensing breathing gas pressure in said storage cylinder, and for causing said generator means to generate breathing gas having a high oxygen concentration when the breathing gas pressure in said storage cylinder drops below a designated pressure value;

means for feeding said high oxygen content breathing gas to said compressor, wherein said compressor may receive the generated high oxygen content breathing gas from said generator means and compresss such gas to increase its pressure; and means for connecting said compressor to said cylinder, to feed said compressed gas into said cylinder, to increase the pressure of gas in said stand-by storage cylinder.

17. A breathing system for supplying physiologically acceptable breathing gas to a pilot of an aircraft having an ejectable pilot seat, the system comprising:

a seat pan mounted to the ejectable pilot seat;

a pressure regulator mounted to said seat pan;

a breathing mask;

means for supplying breathing gas to said regulator, said gas being supplied to said regulator at a feed pressure within a range of feed pressures;

means for connecting said regulator to said mask in a manner so that breathing gas may be communicated from said regulator to said mask, said connecting means also connecting said regulator to said mask in a manner so that said mask may remain connected to said regulator upon ejection of the pilot seat from the aircraft; and means for providing ambient air to said mask, said ambient air means being responsive to said feed pressure of said breathing gas, so that when said feed pressure has a value below a certain pressure value said ambient air means provides ambient air to said mask, and wherein said ambient air means is mounted to said seat pan and remains responsive to said feed pressure upon and after ejection of the pilot seat, to provide ambient air to said mask when said feed pressure has a value below said certain pressure value.

18. The breathing system in accordance with claim 17, wherein said means for supplying breathing gas includes:

means for generating breathing gas onboard the aircraft;

means for providing a stand-by supply of breathing gas;

a selector valve mounted to said seat pan;

a breathing gas receptacle mounted to said seat pan, said receptacle normally being connected to said generating means, and to said stand-by supply means, for receiving breathing gas therefrom, wherein said receptacle is also connected to said selector valve in a manner so that said receptacle feeds breathing gas from said generating means and said stand-by supply means to said selector valve, with said selector valve being connected to said pressure regulator in a manner so that said valve may feed breathing gas from said receptacle to said regulator, and wherein said selector valve may be operable to permit breathing gas to be fed to said regulator from only one of said generating means and said stand-by supply means at any one time.

19. The breathing system in accordance with claim 18, including means for providing an emergency supply of breathing gas to said regulator, said emergency breathing gas being feedable to said regulator when said generating means and said stand-by supply means are disconnected from said selector valve, with said emergency supply means being mounted to said pilot seat, and with said emergency supply means feeding breathing gas to said regulator upon and after ejection of the pilot seat from the aircraft.

20. The breathing system in accordance with claim 19, wherein said ambient air means includes an ambient airflow passageway to said mask, and a valve means positioned in said passageway, with said valve means being responsive to said breathing gas feed pressure, so that when said feed pressure has a value below said certain pressure value said valve means permits ambient air to flow in said passageway to said mask, but when said feed pressure has a value at least as high as said certain pressure value said valve means blocks said passageway to prevent the flow of ambient air to said mask.

21. The breathing system in accordance with claim 20, wherein said receptacle includes a first portion connected to said seat pan, and a second portion, with said generating means being connected to said second portion by a first airflow passageway, and with said stand-by supply means being connected to said second portion by a second airflow passageway, said second portion being connected to said first portion so that breathing gas in said first and second passageways are communicated from both of said generating and said stand-by supply means to said selector valve, and with said selector valve being connected to said regulator by a third airflow passageway, wherein said selector valve may be operable to select breathing gas, from only one of said first and second passageways at any one time, and after such selection, said selector valve may feed breathing gas from the selected passageway into said third passageway, and with said emergency supply means including means for connecting said emergency supply means to said third passageway in a manner so that said emergency supply means may supply breathing gas to said third passageway, wherein upon ejection of the pilot seat from the aircraft, said receptacle second portion separates from said receptacle first portion, with said first portion, said selector valve, said third passageway, said regulator, said mask, said mask connecting means, said ambient airflow means, and said emergency supply means remaining connected to said seat pan upon and after ejection.

22. The breathing system in accordance with claim 21, wherein said emergency supply means includes an emergency breathing gas storage cylinder mounted to said seat pan, a an emergency control valve, and an emergency airflow passageway connecting said emergency storage cylinder to said third passageway, wherein said emergency control valve is positioned in said emergency airflow passageway and is operable to be opened to permit the flow of emergency breathing gas into said emergency airflow passageway and on into said third passageway.

23. The breathing system in accordance with claim 22, including a first one-way check valve positioned in said emergency airflow passageway for permitting emergency breathing gas to flow only in a direction from said emergency gas storage cylinder into said third passageway, and a second one-way check valve positioned in said third passageway for permitting breathing gas to flow only in a direction from said selector valve to said regulator, said second check valve also being positioned so as to permit said valve means to be responsive to breathing gas feed pressure in said passageway, and a third one-way check valve positioned in said ambient airflow passageway between the position of said valve means in said ambient airflow passageway and said mask, said third check valve permitting ambient air to flow only in a direction from said position of said valve means to said mask.

24. The breathing system in accordance with claim 23, including automatic control means for operating said emergency control valve, so that said control valve is opened automatically and immediately upon ejection of the pilot seat from the aircraft.

25. The breathing system in accordance with claim 23, wherein said emergency control valve includes means for manually operating said valve by said pilot to open the valve to provide emergency breathing gas to said regulator.

* * * * *